US007682074B2

(12) United States Patent
Shammai

(10) Patent No.: US 7,682,074 B2
(45) Date of Patent: Mar. 23, 2010

(54) TRUE TEMPERATURE COMPUTATION

(75) Inventor: Michael Shammai, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 11/699,261

(22) Filed: Jan. 29, 2007

(65) Prior Publication Data

US 2008/0180277 A1 Jul. 31, 2008

(51) Int. Cl.

| | |
|---|---|
| ***G01K 13/00*** | (2006.01) |
| ***G01K 3/00*** | (2006.01) |
| ***G01K 7/00*** | (2006.01) |
| ***E21B 47/06*** | (2006.01) |

(52) U.S. Cl. ..... 374/136; 374/102; 374/110; 374/148; 374/166; 73/152.12

(58) Field of Classification Search ..... 374/136, 374/102, 110, 148, 166; 73/152.12
See application file for complete search history.

(56) References Cited

U.S. PATENT DOCUMENTS

| | | | | |
|---|---|---|---|---|
| 2,674,313 A | | 4/1954 | Chambers | |
| 4,343,181 A | * | 8/1982 | Poppendiek | 73/152.13 |
| 4,520,666 A | * | 6/1985 | Coblentz et al. | 73/152.33 |
| 4,573,532 A | | 3/1986 | Blake | |
| 4,575,261 A | * | 3/1986 | Berger et al. | 374/136 |
| 5,159,569 A | * | 10/1992 | Xu et al. | 702/13 |
| 5,415,037 A | * | 5/1995 | Griston et al. | 73/152.12 |
| 5,473,939 A | | 12/1995 | Leder et al. | |
| 5,517,854 A | * | 5/1996 | Plumb et al. | 73/152.59 |
| 6,026,915 A | | 2/2000 | Smith et al. | |
| 6,905,241 B2 | * | 6/2005 | Zazovsky et al. | 374/134 |
| 7,334,637 B2 | * | 2/2008 | Smith, Jr. | 166/288 |
| 7,398,680 B2 | * | 7/2008 | Glasbergen et al. | 73/152.12 |
| 2002/0096321 A1 | * | 7/2002 | Yannick et al. | 166/250.01 |
| 2003/0103551 A1 | * | 6/2003 | Haddad et al. | 374/136 |
| 2004/0006429 A1 | * | 1/2004 | Brown | 702/12 |
| 2004/0190589 A1 | * | 9/2004 | Zazovsky et al. | 374/136 |
| 2007/0129901 A1 | * | 6/2007 | DiFoggio et al. | 702/54 |

* cited by examiner

*Primary Examiner*—Gail Verbitsky
*Assistant Examiner*—Mirellys Jagan
(74) *Attorney, Agent, or Firm*—Bracewell & Giuliani LLP

(57) ABSTRACT

A method and apparatus for estimating the true temperature of connate fluid within a subterranean geological formation is provided herein. The method includes generating a flow of connate fluid, measuring the temperature of the flow over time until the measured temperature reaches a limiting value termed the stabilized temperature. Multiple events of temperature sampling events can be conducted at different flow rates of the connate fluid. The stabilized temperature values can then be ascendingly organized based on the value of their respective flow rates. The limiting value reached by the stabilized temperatures is taken to be substantially equal to the actual temperature of the connate fluid residing within the subterranean formation.

12 Claims, 2 Drawing Sheets

TRUE TEMPERATURE COMPUTATION

BACKGROUND OF THE INVENTION

1. Field of the Invention

The invention relates generally to the field of exploration and production of hydrocarbons from wellbores. More specifically, the present invention relates to an apparatus and method for estimating the temperature of connate fluid sampled from within a subterranean geological formation.

2. Description of Related Art

The sampling of fluids contained in subsurface earth formations provides a method of testing formation zones of possible interest by recovering a sample of any formation fluids present for later analysis in a laboratory environment while causing a minimum of damage to the tested formations. The formation sample is essentially a point test of the possible productivity of subsurface earth formations. Additionally, a continuous record of the control and sequence of events during the test is made at the surface. From this record, valuable formation pressure and permeability data as well as data determinative of fluid compressibility, density and relative viscosity can be obtained for formation reservoir analysis.

Early formation fluid sampling instruments, such as the one described in U.S. Pat. No. 2,674,313, were not fully successful in commercial service because they were limited to a single test on each trip into the borehole. Later instruments were suitable for multiple testing; however, the success of these testers depended to some extent on the characteristics of the particular formations to be tested. For example, where earth formations were unconsolidated, a different sampling apparatus was required than in the case of consolidated formations.

Down-hole multi-tester instruments have been developed with extensible sampling probes for engaging the borehole wall at the formation of interest for withdrawing fluid samples therefrom and measuring pressure. In downhole instruments of this nature it is typical to provide an internal draw-down piston which is reciprocated hydraulically or electrically to increase the internal volume of a fluid receiving chamber within the instrument after engaging the borehole wall. This action reduces the pressure at the instrument/formation interface causing fluid to flow from the formation into the fluid receiving chamber of the tool or sample tank. These pistons accomplish suction activity only while moving in one direction. On the return stroke the piston discharges the formation fluid sample through the same opening through which it was drawn and thus provides no pumping activity. Additionally, unidirectional piston pumping systems of this nature are capable of moving the fluid being pumped in only one direction and thus causes the sampling system to be relatively slow in operation.

The multi-tester instrument includes one or more internal pumps and associated control circuitry which permits the flexibility of selective "direct" pumping, where formation fluid is drawn from the formation and pumped directly into a sample tank and selective "indirect" pumping, where the pressure of an internal sample tank chamber is lowered, thus permitting filling of the sample chamber of the tank by formation fluid solely responsive to the influence of formation pressure. As the sample chamber is filled, a free piston within the sample tank will be moved by formation pressure until it comes into contact with an internal end wall or other internal stop of the sample tank.

After the sample tank has been withdrawn from the wellbore, along with the formation testing instrument, the pressure within the fluid supply passage from the instrument pump to the sample tank is maintained at the preestablished pressure level until a manually operable tank valve is closed. Thereafter, the pump supply line is vented to relieve pressure upstream of the closed sample tank valve. After this has been accomplished, the sample tank and its contents can be removed from the instrument body simply by unthreading a few hold-down bolts. The sample tank is thus free to be withdrawn from the instrument body and provided with protective end closures, thus rendering it to a condition that is suitable for shipping to an appropriate laboratory facility.

Sampling devices have been developed that include the functions and capabilities of measuring the temperature of the connate fluid flowing into the sampling device. The measured temperature may not be accurate because some amount of heat transfer will occur between the connate fluid that flows from the formation 6 and the sampling device. This heat transfer thereby alters the fluid temperature somewhat from its original value. The ambient conditions of the borehole 5 can also contribute to that temperature change. Accordingly the values of temperatures measured by temperature probes within the sampling device are not fully representative of the actual temperature of the connate fluid within the formation 6. Moreover, the above mentioned references concerning these sampling devices do not recognize the temperature gradient between the actual formation connate temperature and the sampled temperature, and thus do not provide an apparatus or method for obtaining the true temperature of the formation connate fluid.

Generally connate fluid samples collected in this fashion are used in a pressure volume temperature (PVT) analysis to determine the relative sample volume at various temperature and pressures. The raw PVT data may be used to tune a model (Equation of state EOS) that quantifies the gas and liquid phase at surface and pipe line pressure and temperature. EOS may then used to estimate the volume of produced hydrocarbon at gas and liquid state. The reservoir pressure and temperature are needed to tune the model at the reservoir condition.

As shown in FIG. 1, the sampling of subterranean formation fluid typically involves the insertion of a sampling tool 10 within a wellbore 5 that intersects the subterranean formation 6. Generally the tool 10 is inserted on the end of a wireline 8 or other armored cable, but can also be disposed within the wellbore 5 on tubing (not shown). When wireline 8 is used, it is typically maintained on a spool from which the tool 10 is reeled within the wellbore 5. When it is established that the tool 10 is adjacent to the region of the formation 6 where sampling is to occur, rotation of the spool is ceased thereby suspending the tool 10 at the proper depth within the wellbore 5. Upon suspending the tool 10 at the predetermined downhole depth, the urging means 12 is extended from the tool 10 that pushes the tool 10 against the inner diameter of the wellbore 5 on the side of the tool 10 opposite to the urging means 12. A probe 14 is provided on the tool 10 opposite to the urging means 12 such that activation of the urging means 14 causes the probe 14 to pierce the inner diameter or wall of the wellbore 5 and extend a small distance into the formation 6. The probe 14 has an annular configuration thereby allowing for fluid flow through its inner annulus. Within this annulus of the probe 14, subterranean fluid can flow from the formation 6 to within the tool 10 for storage and subsequent analysis.

Therefore, there exists a need for a connate fluid sampling system and method capable of sampling connate fluid, wherein the true formation temperature of the connate fluid can be found.

BRIEF SUMMARY OF THE INVENTION

Disclosed herein is a method of estimating subterranean formation connate fluid temperature comprising, sampling connate fluid flow temperature for a period of time, establishing a stabilized temperature value of the connate fluid flow sampled, repeating the steps of sampling and establishing a stabilized temperature value, obtaining a stabilized temperature value for each corresponding connate fluid flow, and estimating the temperature of connate fluid residing in the formation based on the relationship between the stabilized temperatures obtained for each flow of connate fluid and the flowrate for each connate fluid flow.

Also disclosed herein is a method of evaluating connate fluid from a downhole formation comprising, generating a flow of connate fluid, measuring the temperature of the flow of connate fluid, wherein the temperature is measured at time intervals over a period of time, determining the value of the stabilized temperature wherein the measured temperature remains substantially constant between successive time intervals within the period of time and repeating these steps. The method of evaluating connate fluid includes sequentially arranging the determined temperatures based on the ascending value of their respective corresponding flow rates of connate fluid, and estimating the connate fluid temperature within the downhole formation; wherein the temperature remains substantially constant among a series of sequentially arranged values of the flow rate of the connate fluid.

The present disclosure includes a connate fluid analysis system comprising, a connate fluid probe, a temperature probe in fluid communication with the probe, and an analyzer in communication with the temperature probe. The analyzer may be configured to receive temperature values of connate fluid flow, wherein the temperature values comprise recorded temperatures of at least two connate fluid flow streams. The analyzer may be further configured to identify a stabilized temperature for each connate fluid flow stream, and to determine a formation temperature based on the relationship between the stabilized temperatures and the flow rate of their corresponding connate fluid flow stream.

DETAILED DESCRIPTION OF THE INVENTION

Figure 2:
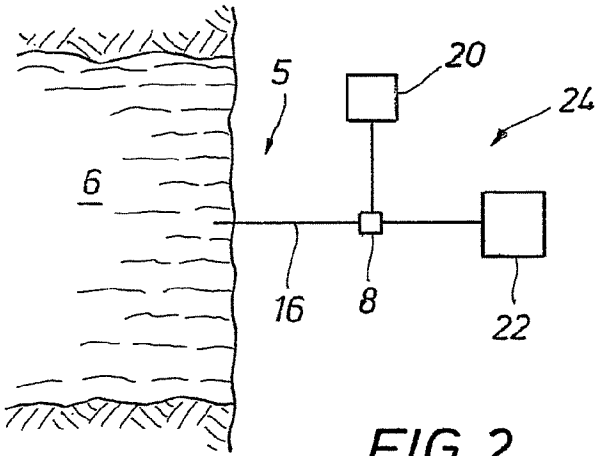
FIG. 2 illustrates a sample plot illustrating fluid temperature vs. time.

The method and apparatus disclosed herein are useful for estimating the temperature of connate fluid sampled from within a subterranean geological formation. A description of the application of the aforementioned method and apparatus can be found in the embodiments of the figures described herein. With regard to the figures, FIG. 2 is a partial cut away with a functional block diagram of how an embodiment of the present method can be used. In this embodiment, a sampling device 24 is in fluid communication with the connate fluid of a formation 6. The sampling device 24 comprises a probe 16 that pierces the inner wall of the wellbore and extends into the formation 6. The sampling device 24 further comprises a pump 22 useful for drawing the connate fluid from the formation and into the probe 16. Disposed within the probe 16 upstream of the pump 22 is a thermal well 18. The thermal well 18 includes a temperature sensitive apparatus for sensing the temperature of the connate fluid flowing through the probe 16. One example of a temperature sensitive apparatus for use with the device herein is a Class A RTD (Resistance Temperature Detector). A controller 20 can be optionally provided that is in electrical or telemetry communication with thermal well 18. As will be described in further detail below, the optional controller 20 can receive temperature data of the connate fluid for storage and/or processing.

Due to heat energy loss from the connate fluid into the sampling equipment and wellbore, the initial stages of a connate fluid sampling phase will likely reflect connate fluid temperatures that are less than the temperature of the connate fluid that is actually in the formation 6. Over time as the connate fluid flow is passed through the line 16 however, the sample temperature will begin to rise and approach a value that can be termed the stabilized temperature. The amount of time for a particular sampling application to reach the stabilized temperature can vary. This time variance depends upon the specific heats of the sampling apparatus, the temperature difference between the formation 6 and within the wellbore 5, the value of the flow rate, as well as the responsiveness of the temperature probe used in this application.

Figure 3A:
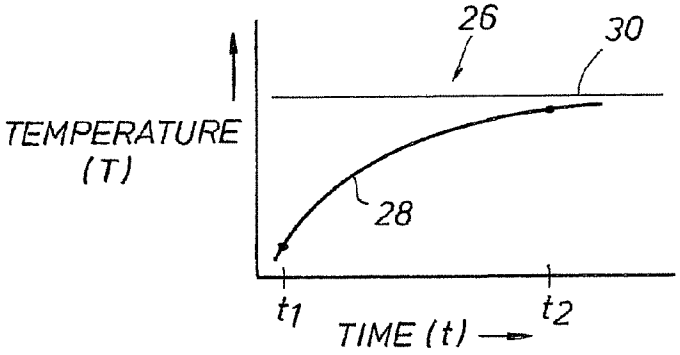
FIG. 3 portrays a plot of fluid temperature vs. fluid flow rate.

An example of how the measured temperature will change over time can be found in FIG. 3*a*. FIG. 3*a* displays a measured temperature graph plotted in a Cartesian coordinate system. Here, the ordinate is temperature (T) and the abscissa is time (t). The measured temperature graph 26 includes a measured temperature plot 28 that specifically illustrates the relationship between temperature and time of the sampled connate fluid. To ensure valid results, the flow rate of the connate fluid should be maintained at a constant level. As shown, the measured temperature plot 28 has a generally asymptotic form wherein over time the temperature begins to stabilize such that subsequent values of temperature are substantially the same. Also shown is an asymptote 30 that is substantially tangential to the point where the temperature values are stabilized. This is also known as the limiting value.

Figure 3B:
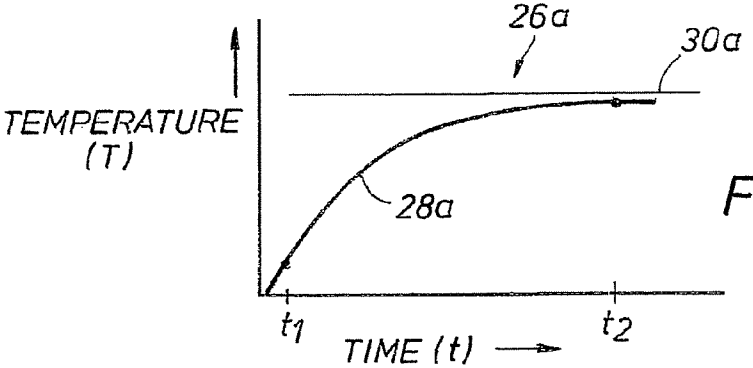
Figure 1:
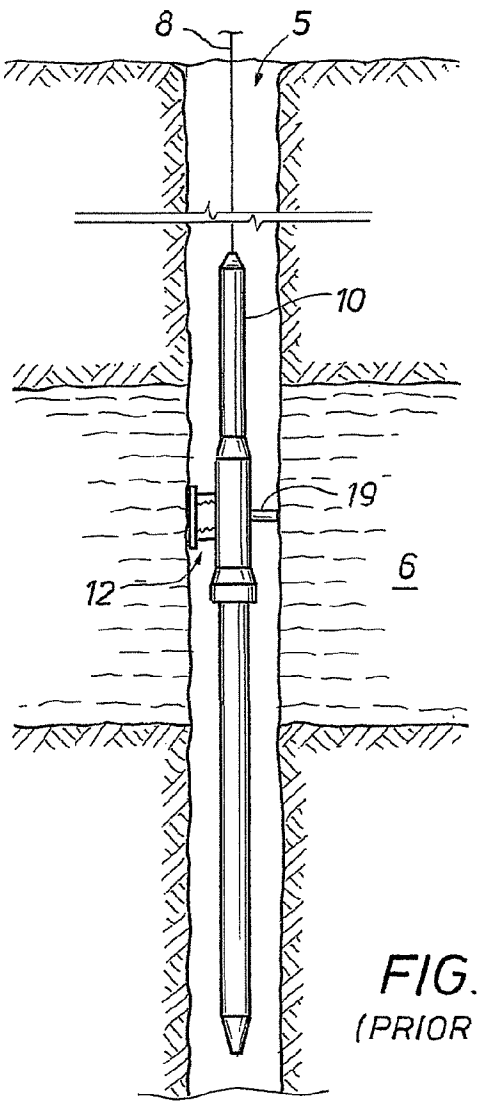
FIG. 1 (PRIOR ART)
FIG. 1 is a partial cross-sectional view of a sampling tool disposed within a wellbore.

FIG. 3*b* provides a measured temperature graph 26*a* for another hypothetical connate temperature sampling, wherein the sampling event has a flow rate different from the sampling event illustrated in FIG. 3*a*. While the slope of the measured temperature plot 28*a* of FIG. 3*b* differs somewhat, it still is exponential and the temperature (T) stabilizes at some time period. Accordingly a corresponding asymptote 30*a* can be applied tangential to the limiting point or stabilized temperature of the measured temperature graph 26*a* of FIG. 3*b* . In one example of use of the method described herein, the time period (or total time) of temperature measurement ranges from about 15 to about 45 minutes. The interval times between successive temperatures readings used to create the figures can range from about 900 to about 3600 seconds, other variations include a range from 1200 to 2000 seconds and about 1800 seconds.

The method herein described thus includes selecting connate fluid samples at different flow rates thereby obtaining a stabilized and/or limiting temperature for each of the corresponding flow rates of the sampled connate fluid. Once these stabilized temperature values are found and recorded, they can be collated and/or stored with their corresponding flow rate. With regard to FIG. 4, an estimated temperature graph 32 is shown wherein the stabilized temperature values are shown plotted in a Cartesian coordinate graph with their corresponding flow rates. The temperature (T) is shown in the ordinate whereas the flow rate (Q) is shown in the abscissa. The estimated temperature graph 32 includes an estimated temperature plot 34. As with the prior temperature plots the estimated temperature plot also takes on a somewhat exponential form wherein with increasing values of flow rate the estimated temperature value approaches a limiting value. This limiting value can be approximated by the tangentially drawn asymptote 36. It has been found that an estimated value of the temperature of the connate fluid residing within the formation can be obtained by this limiting temperature value of FIG. 4. As such, if the asymptote line 36 is drawn toward the ordinate temperature line the corresponding value of temperature intersecting the asymptote 36 can be taken as a useful and valuable estimate of the connate fluid within the formation 6. It should be pointed that the period of time over which a sampling of the flow connate fluid will vary depending upon the temperature gradient between the ambient conditions of the sampling device 24 and the actual temperature of the connate fluid within the formation 6. Other considerations such as the flow rate of connate fluid also come into play. However it is well within the capabilities of those skilled in the art to determine an appropriate period of time for sampling the connate fluid flow. Moreover, the length and frequency of the time intervals within the time period can also be determined by those skilled in the art.

An estimate of an asymptotic graph may be created with as few as two temperature data points. However more precise results are attainable by taking additional measurements, for example a measured temperature plot may be produced with three, four, five, as well as up to 20 data measurements.

Figure 4:
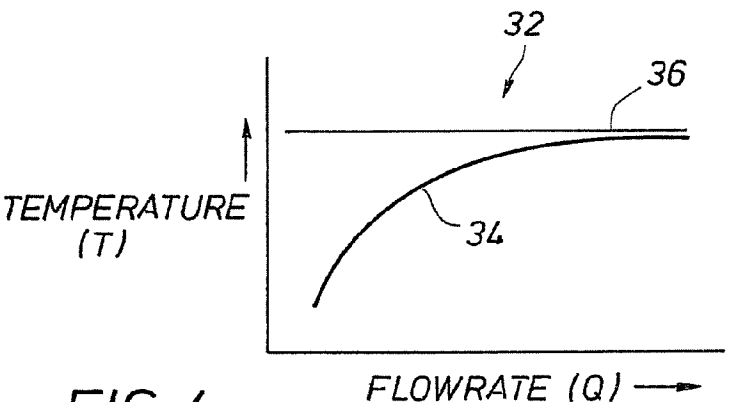
FIG. 4 demonstrates a plot of stabilized temperature vs. corresponding flowrates.

While the graphs and plots of FIGS. 3*a*, 3*b* and 4 illustrate one manner of obtaining values for stabilized temperature and an estimate of the temperature of the connate fluid, other ways of finding these values can be performed in lieu of these figures. For example, a sequential ranking of the stabilized temperature over time can be evaluated on a time interval basis and the value for the stabilized temperature from the measured temperature can be obtained with an algorithm. The algorithm can evaluate the differences between successive values of measured temperatures and when the differences begin to fall within a certain range over a period of time intervals, the value for stabilized temperature can be set substantially equal to this value of measured temperature. The same technique can be used in arriving at a value for the estimate of the temperature of the connate fluid in the formation. That is, once the values for the stabilized temperatures are sequentially ranked in order of their ascending value of corresponding flow rate, a similar algorithm can be applied that assesses the differences in the values of stabilized temperature and when this difference falls within a range over a period of ascending flow rates. These values for stabilized temperature can be used as an estimate of the connate fluid temperature in the formation.

It should be pointed out that the present disclosure also includes whether the processor 20 includes either firmware, software, or hard wired components that are capable of assessing the values of both the measured temperature and arriving at a value for a stabilized temperature in accordance with the above disclosure. This processor 20 is also capable of taking the determined values of stabilized temperature in order to arrive at a value for estimated temperature of the connate fluid within the formation 6. With regard to the pump 22, this device can be comprised of any apparatus capable of creating a pressure differential thereby urging connate fluid from the formation 6 through the line 16 and past the thermal well 18. The sampling device 24 of FIG. 2 is shown adjacent to the formation 6. In one embodiment the sampling device 24 could be disposed within a downhole tool 10 disposable into a well bore for conducting sampling operations. In this embodiment the probe 16 could extend from within the downhole tool 10 and into the formation.

In one mode of operation fluid samples may be taken at more than one flow rate. However when varying the flow rate, better results may be obtained by taking the multi-flow rate samples at the same location in the wellbore. Changing the location along with changing the flow rate can introduce variables that may ultimately skew the results.

Figure 5:
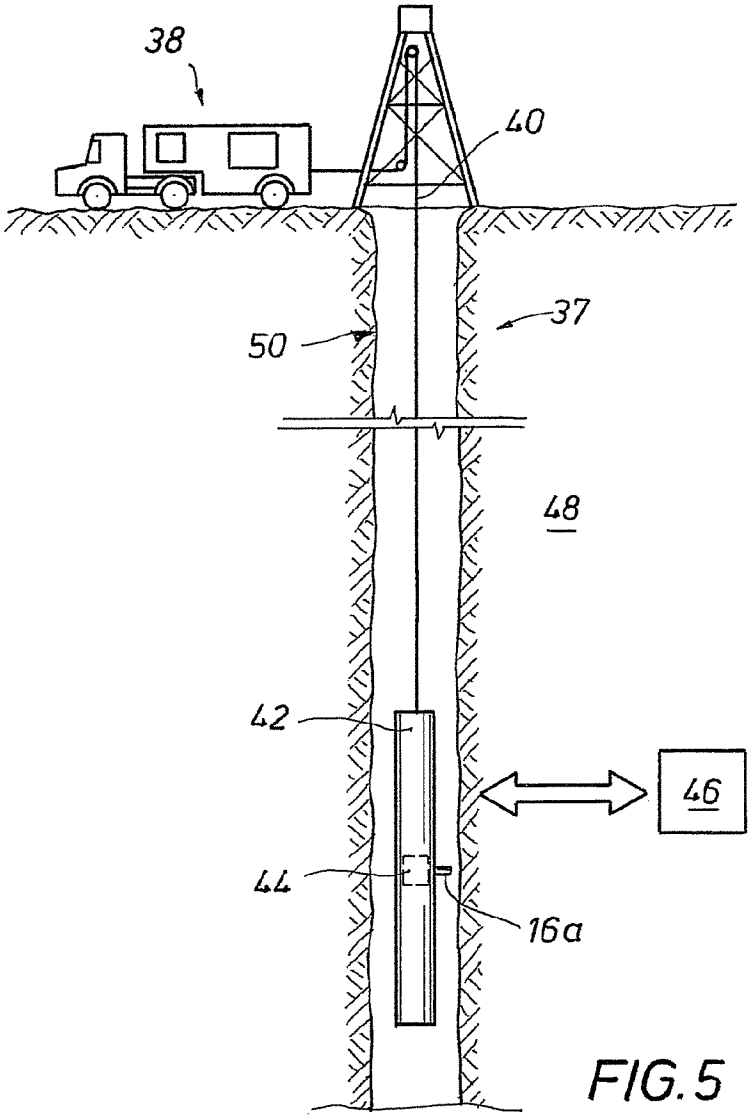
FIG. 5 portrays in partial cut-away side view, an embodiment of a connate fluid sampling system.

With reference now to FIG. 5, one embodiment of a connate fluid analysis system 37 is shown. The system comprises a surface truck 38 combined with a downhole tool 42. As shown, the downhole tool 42 is disposed within a wellbore 50 on wireline 40. Optionally however other means may be employed for employing the downhole tool 42 with the wellbore 50, such as coiled tubing, slickline, and drill pipe, to name but a few. In the embodiment of FIG. 5, the wireline 40 not only is used to deploy the downhole tool 42 but also provides communication between the downhole tool 42 and the surface.

The downhole tool 42 includes a probe 16*a* shown extending substantially perpendicular to the axial length of the tool 42. However, embodiments of the probe 16*a* include any arrangement that allows for insertion of the probe 16*a* through the wellbore wall and into the formation 48 that surrounds the wellbore 50. Also included within the tool is a module 44 configured to receive connate fluid from within the adjacent formation 48. The module 44 may include temperature measuring devices as well as connate fluid pumps for urging the connate fluid through the probe 16*a* and into the module 44.

An analyzer 46 is also included within the system 37, which is shown in communication with the downhole tool 42. The analyzer 46 may be disposed wholly within the tool 42, may be at surface such as in the surface truck 38, or at some remote location. Accordingly the communication between the downhole tool 42 and the analyzer 46 may be directly connected, connected through hard wire, or further remotely connected through telemetry. Thus the analyzer 46 may be configured to receive the temperature data above discussed and create the resulting figures based upon the time and temperature readings of the aforementioned steps. Moreover, the analyzer 46 may be used for controlling the method steps of the downhole tool 42 when taking connate fluid temperature measurements. The controller may be a microprocessor disposed within the downhole tool, may be an information handling system, or some other device capable of receiving data and analyzing that data to produce such results.

One specific example of an analyzer 46 is an information handling system (IHS). An IHS may be employed for controlling the steps of sampling and analyzing the connate fluid and upward and downward movement of the downhole tool 42 in the wellbore 50. Moreover, the IHS may also be used to store recorded measurements as well as processing the measurements into a readable format. The IHS may be disposed at the surface, in the wellbore, or partially above and below the surface. The IHS may include a processor, memory accessible by the processor, nonvolatile storage area accessible by the processor, and logics for performing each of the steps above described.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example the method described herein can be accomplished with downhole processor or computer, having software code stored therein or supplied from the surface. Additionally, the steps and apparatus herein described are not limited to discerning connate fluid temperature alone, but can be used in conjunction with other evaluation techniques. It should be pointed out that the present method and apparatus can be used with any type of sampling device that is now in use or those developed and used in the future. These and other similar modifications will readily suggest themselves to those skilled in the art, and are intended to be encompassed within the spirit of the present invention disclosed herein and the scope of the appended claims.

What is claimed is:

1. A method of estimating subterranean formation connate fluid temperature comprising;

(a) sampling connate fluid flow temperature for a period of time;

(b) establishing a stabilized temperature value of the connate fluid flow of step (a);

(c) repeating steps (a) and (b) and obtaining a stabilized temperature value for each corresponding connate fluid flow; and (d) estimating the temperature of connate fluid residing in the formation based on the relationship between the stabilized temperatures obtained for each flow of connate fluid and the flowrate for each connate fluid flow.

2. The method of estimating connate fluid flow temperature of claim 1, wherein the fluid flow temperature is measured at discrete time intervals selected from the list consisting of from about 900 seconds to about 3600 seconds, from about 1200 to about 2000 seconds, and about 1800 seconds.

3. The method of estimating connate fluid flow temperature of claim 1, wherein step (b) includes measuring temperature at discrete time intervals and when temperatures measured at subsequent time intervals are substantially the same, identifying the stabilized temperature to be the substantially the same measured temperatures.

4. The method of estimating connate fluid flow temperature of claim 1, further comprising repeating steps (a)-(c) at different locations in a wellbore.

5. The method of estimating connate fluid flow temperature of claim 1 wherein said stabilized temperature of step (b) is obtained by creating a first Cartesian coordinate plot by graphing the measured temperature with respect to the time intervals wherein the stabilized temperature is substantially equal to an asymptote at the limiting value of said first Cartesian coordinate plot.

6. The method of estimating connate fluid flow temperature of claim 1, wherein the flowrate of the flow of connate fluid of step (a) can vary when repeating step (a).

7. The method of estimating connate fluid flow temperature of claim 1, wherein step (d) further comprises creating a second Cartesian coordinate plot of the stabilized temperatures of step (c) on one coordinate and their respective flow rates on another coordinate, wherein the estimate of the connate fluid temperature is substantially equal to an asymptote at the limiting value of temperature on said second Cartesian coordinate plot.

8. The method of estimating connate fluid flow temperature of claim 1, wherein step (c) is repeated at least twice.

9. The method of estimating connate fluid flow temperature of claim 1, wherein step (c) is repeated at least four times.

10. The method of estimating connate fluid flow temperature of claim 1, wherein the time period is about 30 minutes.

11. The method of estimating connate fluid flow temperature of claim 1, further comprising urging connate fluid from the subterranean geological formation with a pumping device, wherein the pumping device creates the flow of connate fluid.

12. The method of estimating connate fluid flow temperature of claim 11, further comprising disposing said pumping device within a sonde, inserting said sonde within a borehole, and penetrating the subterranean geological formation, providing fluid communication between the subterranean geological formation and the pumping device.

* * * * *